US010463165B2

(12) United States Patent
Ishibashi et al.

(10) Patent No.: US 10,463,165 B2
(45) **Date of Patent: *Nov. 5, 2019**

(54) AIR MATTRESS HAVING A PLURALITY OF AIR CELL GROUPS

(71) Applicant: PARAMOUNT BED CO., LTD., Tokyo (JP)

(72) Inventors: Yoshinori Ishibashi, Tokyo (JP); Rika Matsumiya, Tokyo (JP); Kenta Ohno, Tokyo (JP)

(73) Assignee: PARAMOUNT BED CO., LTD., Tokyo (JP)

( * ) Notice: Subject to any disclaimer, the term of this patent is extended or adjusted under 35 U.S.C. 154(b) by 356 days.

This patent is subject to a terminal disclaimer.

(21) Appl. No.: 15/341,638

(22) Filed: Nov. 2, 2016

(65) Prior Publication Data

US 2017/0095090 A1 Apr. 6, 2017

Related U.S. Application Data

(63) Continuation of application No. 13/519,301, filed as application No. PCT/JP2010/068301 on Oct. 19, 2010, now Pat. No. 9,597,244.

(30) Foreign Application Priority Data

Feb. 5, 2010 (JP) ..... 2010-024890

(51) Int. Cl.
*A47C 27/08* (2006.01)
*A61G 7/057* (2006.01)
(Continued)

(52) U.S. Cl.
CPC ..... *A47C 27/083* (2013.01); *A61G 7/015* (2013.01); *A61G 7/018* (2013.01); *A61G 7/0527* (2016.11);
(Continued)

(58) Field of Classification Search
CPC ..... A47C 27/083; A61G 7/05769; A61G 7/0527; A61G 7/015; A61G 7/018;
(Continued)

(56) References Cited

U.S. PATENT DOCUMENTS 4,768,249 A 9/1988 Goodwin
4,796,948 A * 1/1989 Paul ..... A61G 5/1043 297/284.1
(Continued)

FOREIGN PATENT DOCUMENTS

EP 0 528 666 A1 2/1993
EP 0 878 150 A2 11/1998
(Continued)

OTHER PUBLICATIONS

Extended European Search Report dated Dec. 15, 2015.
(Continued)

*Primary Examiner* — Robert G Santos
*Assistant Examiner* — Myles A Throop
(74) *Attorney, Agent, or Firm* — McGinn I.P. Law Group, PLLC.

(57) ABSTRACT

An air mattress includes a plurality of air cell groups including air cell groups corresponding to the back area, the buttock area and the thigh area of a person lying on the air mattress, each of which groups being made of a plurality of air cells, an air supply/release pump, an air tube connecting the air cell groups corresponding to the back area and the thigh area to the air supply/release pump and connecting the air cell group corresponding to the buttock area to the air supply/release pump in an independent system for each other, and a controller for controlling, when the back area is raised, so that the pressure of the air cell groups corresponding to the back area and thigh area is increased.

6 Claims, 10 Drawing Sheets

(51) Int. Cl.
*A61G 7/015* (2006.01)
*A61G 7/018* (2006.01)
*A61G 7/05* (2006.01)

(52) U.S. Cl.
CPC ..... *A61G 7/05769* (2013.01); *A61G 7/05776* (2013.01); *A61G 2203/34* (2013.01); *A61G 2203/42* (2013.01); *A61G 2203/44* (2013.01); *A61G 2203/46* (2013.01)

(58) Field of Classification Search
CPC ..... A61G 7/05776; A61G 2203/42; A61G 2203/46; A61G 2203/44; A61G 2203/34
See application file for complete search history.

(56) References Cited

U.S. PATENT DOCUMENTS

| | | | | |
|---|---|---|---|---|
| 4,987,620 | A | 1/1991 | Sharon | |
| 5,138,729 | A | 8/1992 | Ferrand | |
| 5,555,582 | A | 9/1996 | Jerideau | |
| 5,611,096 | A * | 3/1997 | Bartlett | A61G 7/001 5/424 |
| 5,659,910 | A | 8/1997 | Weiss | |
| 5,996,150 | A | 12/1999 | Belvins | |
| 6,009,580 | A | 1/2000 | Caminade et al. | |
| 6,892,405 | B1 * | 5/2005 | Dimitriu | A61G 7/001 5/609 |
| 7,296,312 | B2 | 11/2007 | Menkedick et al. | |
| 7,406,731 | B2 | 8/2008 | Menkedick et al. | |
| 7,506,390 | B2 | 3/2009 | Dixon et al. | |
| 7,520,006 | B2 | 4/2009 | Menkedick et al. | |
| 7,533,429 | B2 | 5/2009 | Menkedick et al. | |
| 7,669,263 | B2 | 3/2010 | Menkedick et al. | |
| 7,703,158 | B2 | 4/2010 | Wilker, Jr. et al. | |
| 2004/0255386 | A1 | 12/2004 | Liu | |
| 2005/0077859 | A1 | 4/2005 | Nagaoka | |
| 2005/0172406 | A1 | 8/2005 | Menkedick et al. | |
| 2005/0268401 | A1 * | 12/2005 | Dixon | A61B 5/1115 5/655.3 |
| 2006/0096029 | A1 | 5/2006 | Menkedick et al. | |
| 2006/0162079 | A1 | 7/2006 | Menkedick et al. | |
| 2006/0168730 | A1 | 8/2006 | Menkediok et al. | |
| 2006/0168731 | A1 | 8/2006 | Menkedick et al. | |
| 2008/0010748 | A1 | 1/2008 | Menkedick et al. | |
| 2008/0201847 | A1 | 8/2008 | Menkedick et al. | |
| 2008/0201851 | A1 | 8/2008 | Menkedick et al. | |
| 2008/0289108 | A1 | 11/2008 | Menkedick et al. | |
| 2008/0307582 | A1 | 12/2008 | Flocard et al. | |
| 2009/0100605 | A1 | 4/2009 | Caminade et al. | |
| 2009/0144909 | A1 | 6/2009 | Skinner et al. | |
| 2012/0291204 | A1 | 11/2012 | Takeda et al. | |

FOREIGN PATENT DOCUMENTS

| | | | |
|---|---|---|---|
| JP | 2006-297056 | A | 11/2006 |
| JP | 2006-515995 | A5 | 11/2006 |
| KR | 10-2005-0036735 | A | 4/2005 |
| WO | WO 2007/008830 | A2 | 1/2007 |
| WO | WO 2007/008830 | A3 | 1/2007 |
| WO | WO 2009/049131 | A2 | 4/2009 |

OTHER PUBLICATIONS

International Search Report in PCT/JP2010/068301 dated Dec. 7, 2010 (English Translation Thereof).
Office Action in U.S. Appl. No. 13/519,301 dated Mar. 26, 2016.
Office Action in U.S. Appl. No. 13/519,301 dated Oct. 9, 2015.
Office Action in U.S. Appl. No. 13/519,301 dated Jan. 4, 2016.
Office Action in U.S. Appl. No. 13/519,301 dated Jul. 8, 2016.

* cited by examiner

AIR MATTRESS HAVING A PLURALITY OF AIR CELL GROUPS

TECHNICAL FIELD

The present application is a Continuation Application of U.S. patent application Ser. No. 13/519,301, filed on Jun. 26, 2012, which is based on International Application No. PCT/JP2010/068301, filed on Oct. 19, 2010, which is based on Japanese Patent Application No. 2010-024890 filed on Feb. 5, 2010, the contents of which is incorporated herein by reference in its entirety.

BACKGROUND ART

Conventionally, an air mattress such as that disclosed in patent document 1 is known. Patent document 1 discloses a technique in which air bladders corresponding to the thigh area, right and left shoulder area, or buttock area of a person reclining upon a base mat of an air mattress are provided, the supply and release of air to and from these air bladders is controlled by a control device, and the breathing motions of the person lying on the air mattress are assisted.

An example of a mattress used by being laid on a bed is disclosed in patent document mattress according to the physique, body weight, position, or movements of a bed user.

PRIOR ART LITERATURE

Patent Literature

Patent document 1: Unexamined Japanese Patent Application Publication No. 2006-297056

Patent document 2: Japanese Translation of International Patent Application Publication PCT (WO) 2009-500131

DISCLOSURE OF THE INVENTION

Problems the Invention is Intended to Solve

However, the following problems are present in the above described prior art. FIG. 11 is a schematic illustration of an exemplary instance of the air mattress disclosed in patent documents 1 and 2 above used by being laid on a frame of a bed having a raisable back frame. The air mattress disclosed in patent documents 1 and 2 above is not intended for use by being laid on a frame of a bed having a raisable back frame. Thus, the pressure of the air mattress does not depend upon the back raising angle of the back frame but rather is constant. As such, as shown in FIG. 11, when the air mattress 1 disclosed in patent documents 1 and 2 above is laid on the frame of a bed 2 having a raisable back frame and the back frame is raised, a large localized pressure is placed upon the air mattress 1 corresponding to the buttock area of the person. As such, the part of the air mattress 1 corresponding to the buttock area of the person is compressed, mattress compression in which the mattress caves in prominently occurs, and, depending on the hardness of the support platform of the bed, the person on the air mattress feels discomfort in the buttock area. In this case, there is the problem that if the person on the air mattress 1 is, for example, a bedridden patient or the like, a great constant pressure is placed upon the buttock area of the patient or the like, and there is a possibility of decubitus ulcers occurring.

Specifically, there is the problem that, while a sensor is conventionally used to detect information such as body weight and the like for a person on the air mattress and internal pressure is controlled on the basis of the detected results in the case of an air mattress set up on a flat location, as in patent documents 1 and 2 above, in order to allow the air mattress to function independently, in cases in which the bed has a specific function, such as a back frame raising function as in the case of the above example, it is not possible to link mattress pressure control with the function of the bed, which leads to mattress compression or the like occurring.

Also, when many sensors are provided in the air mattress as in the case of patent documents 1 and 2, there is also the problem of increased air mattress manufacturing costs.

An object of the present invention is to provide an air mattress in which internal pressure can be controlled according to the movements of a bed.

Means for Solving the Problems

The air mattress according to the present invention is used by being laid on a frame of a bed. The air mattress comprises a plurality of air cell groups lined up in the lengthwise direction of the air mattress, each of which groups being constituted by a plurality of bladder-shaped cells; an air supply/release pump; an air tube connecting said air cell groups and said air supply/release pump in an independent system for each air cell group of two or more air cell groups out of said air cell groups; and a controller for receiving at least a part of information out of information needed to control said bed from an external sensor for detecting said information and controlling air supply/release for the air supply/release pump for each of said air cell groups on the basis of the received information.

In the air mattress described above, the bladder-shaped cells of said air cell groups are, for example, rod-shaped cells extending in the widthwise direction of the air mattress, and the bladder-shaped cells are configured so as to be lined up in the lengthwise direction of the air mattress.

Said bed has, for example, a plurality of frames including at least a raisable back frame, and the information from said external sensor is information regarding the raising angle of said back frame.

In this case, said plurality of air cell groups includes, for example, air cell groups corresponding to the back area and the thigh area of a person lying on the air mattress; and when said back frame is raised, said controller increases the pressure of said air cell groups corresponding to the back area and thigh area, and performs control so that the pressure of said back area and thigh area air cell groups is greater than the pressure of said buttock area air cell group.

Also, as the angle to which said back frame is raised increases, said controller controls the pressure of said air cell groups so that, for example, the pressure of said buttock area air cell group increases.

In the air mattress described above, the information from said external sensor is, for example, information on the body weight of a person lying on the air mattress, and said controller controls the pressure of said air cell group to increase as body weight increases.

Effects of the Invention

In the air mattress according to the present invention, the controller receives at least a part of information from the external sensor for detecting information needed to control the bed, and controls air supply/release of the air supply/release pump for each of the air cell groups on the basis of the received information. It is thereby possible to control the internal pressure of the air mattress according to the movements of the bed.

As such, according to the air mattress of the present invention, it is possible to prevent the occurrence of mattress compression or the like, and effectively disperse body pressure.

BEST MODE FOR CARRYING OUT THE INVENTION

Figure 1:
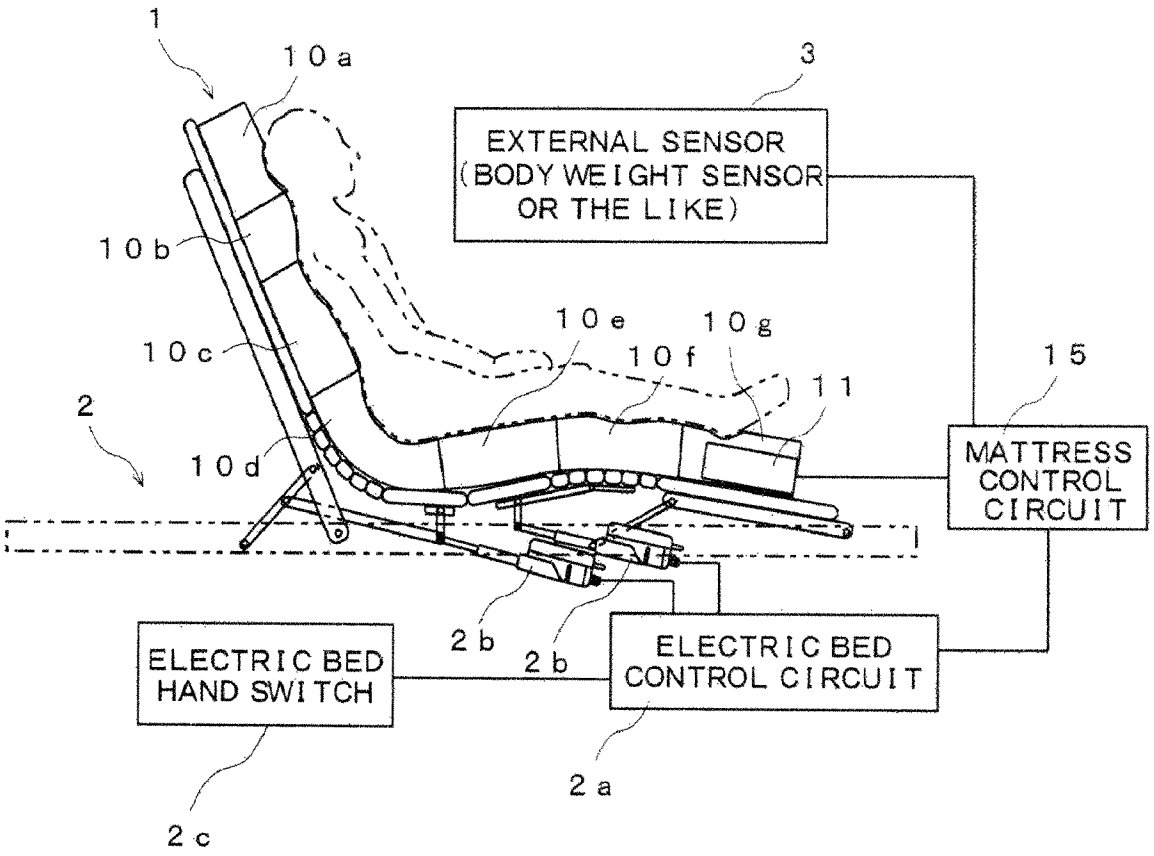
FIG. 1 is a schematic view of an air mattress and a bed according to a first embodiment of the present invention.
Figure 2:
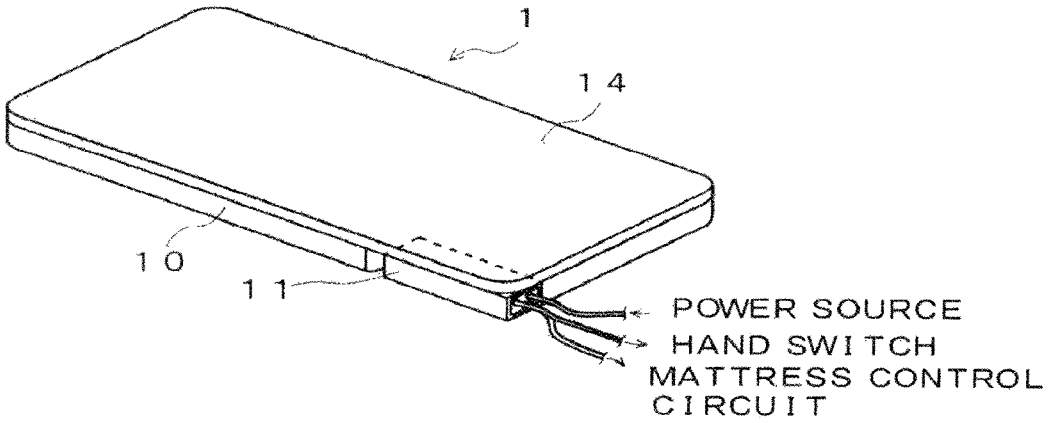
FIG. 2 is a perspective view of an air mattress according to an embodiment of the present invention.
Figure 3:
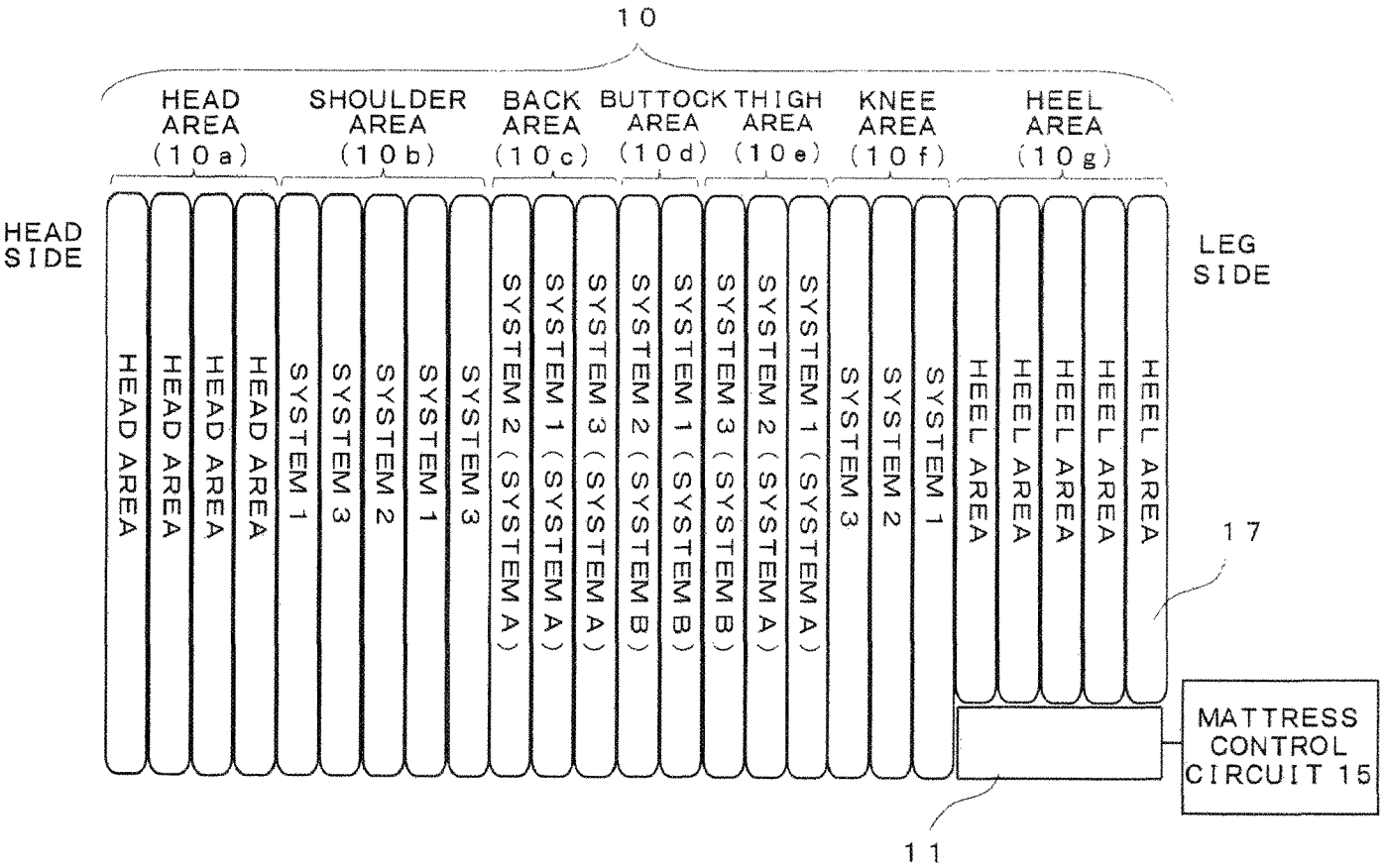
FIG. 3 is a plan view of the disposition of each of the bladder-shaped cells and the air supply/release pump of an air mattress according to an embodiment of the present invention.
Figure 4:
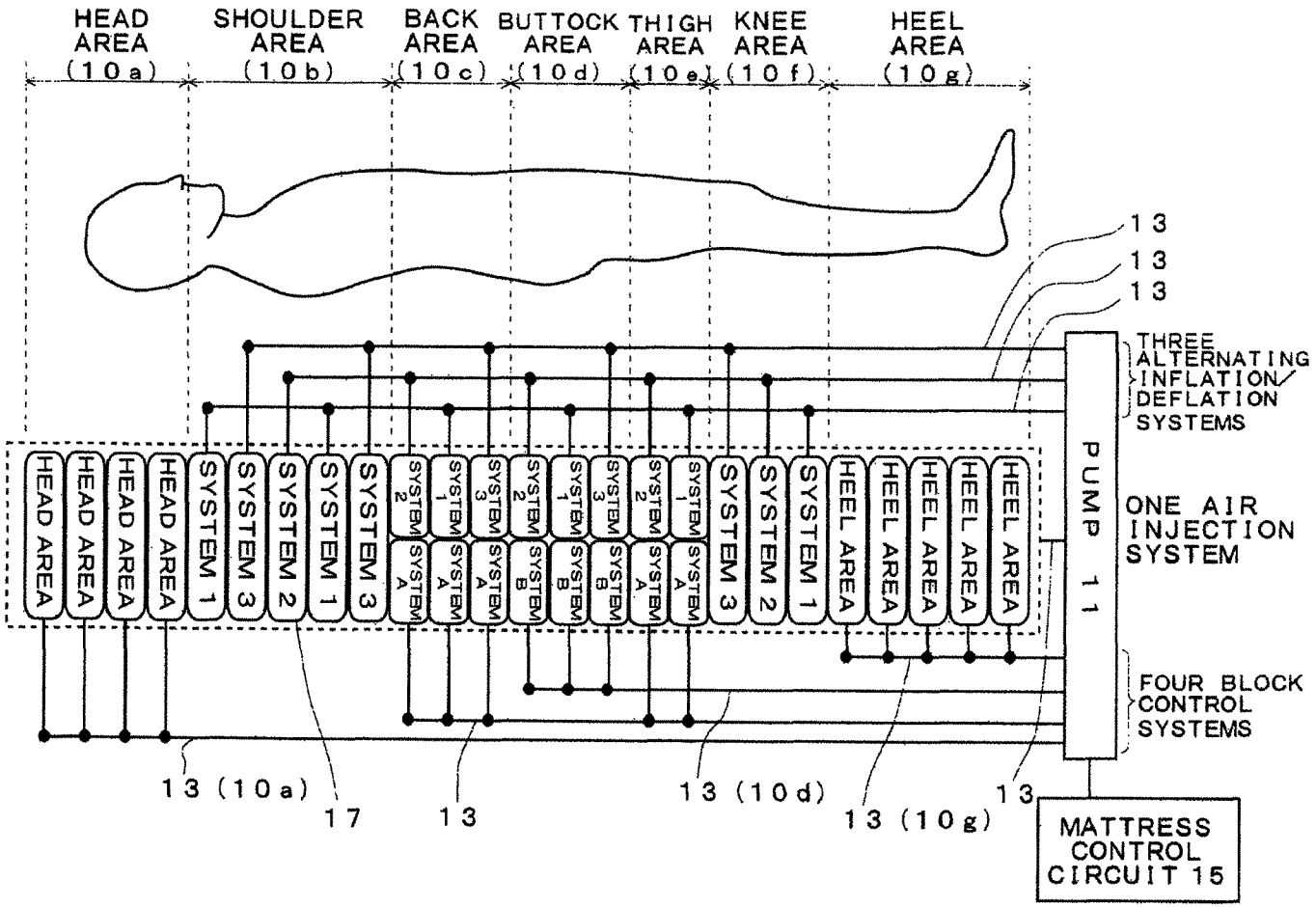
FIG. 4 is a schematic view of air supply/release systems for each of the bladder-shaped cells of an air mattress according to an embodiment of the present invention.
Figure 5:
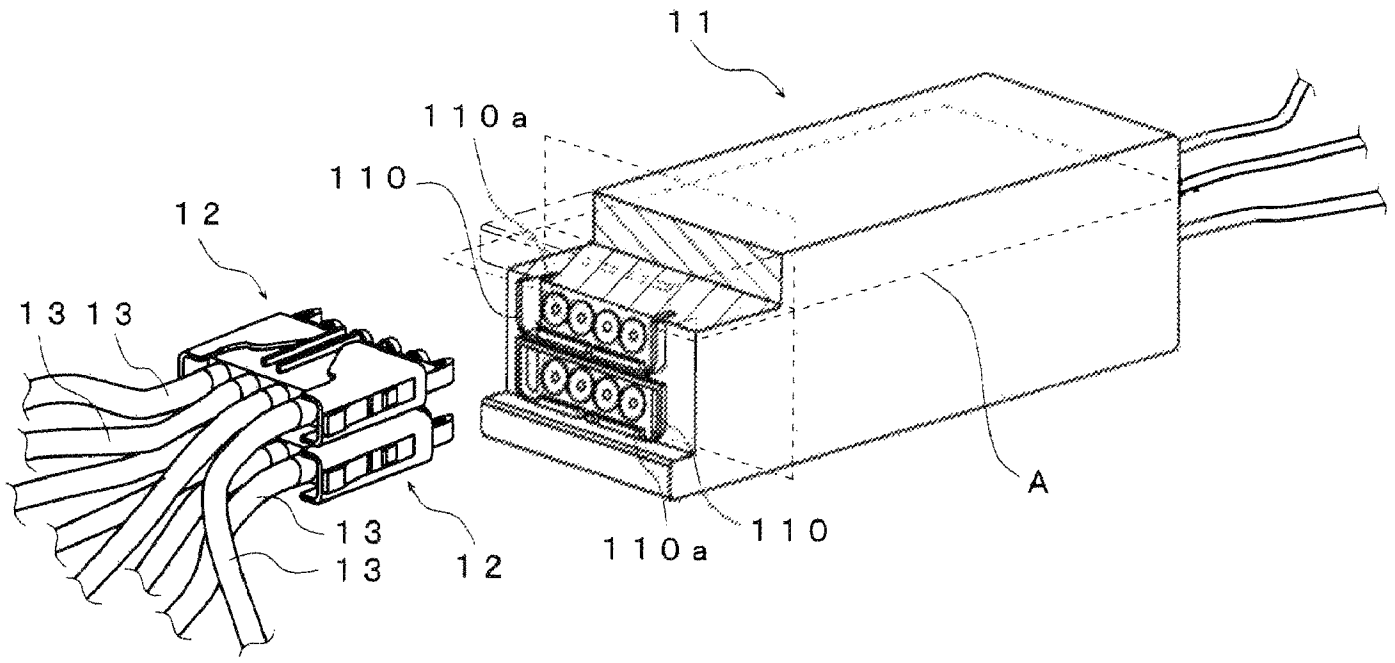
FIG. 5 is a perspective view of an air supply/release pump and a connector of an air mattress according to an embodiment of the present invention.
Figure 6:
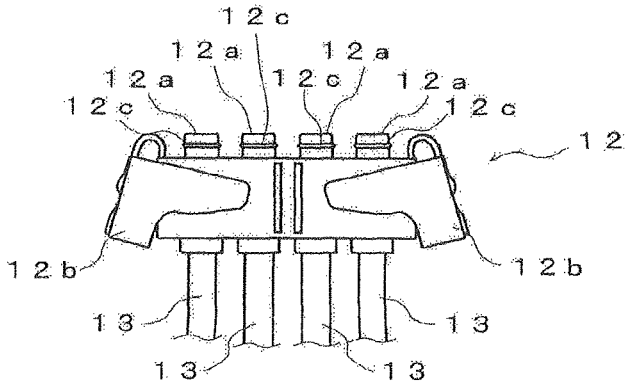
FIG. 6 is a plan view of an air tube-side connector of an air mattress according to an embodiment of the present invention.
Figure 7A:
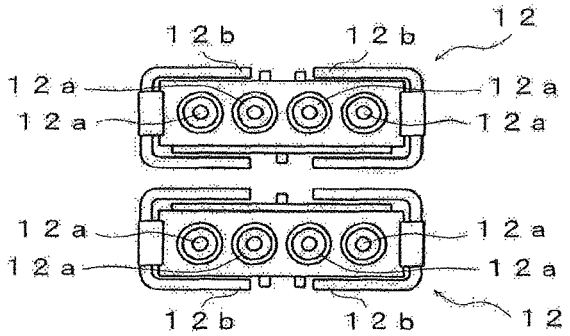
FIGS. 7A and 7B are views of an air tube-side connector of an air mattress according to an embodiment of the present invention from a mating surface side thereof.
Figure 7B:
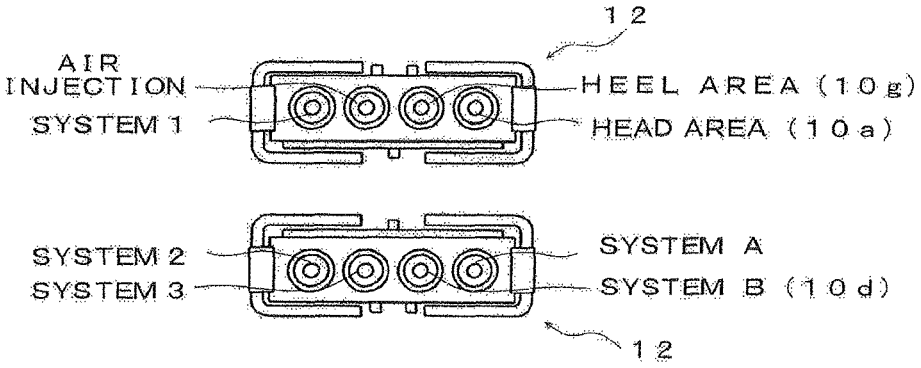

Hereafter follows a detailed description of an air mattress according to an embodiment of the present invention with reference to the attached drawings. FIG. 1 is a schematic view of an air mattress and a bed according to a first embodiment of the present invention, FIG. 2 is a perspective view of an air mattress according to an embodiment of the present invention, FIG. 3 is a plan view of the disposition of each of the bladder-shaped cells and the air supply/release pump of an air mattress according to an embodiment of the present invention, and FIG. 4 is a schematic view of air supply/release systems for each of the bladder-shaped cells of an air mattress according to an embodiment of the present invention. FIG. 5 is a perspective view of an air supply/release pump and a connector of the present embodiment, FIG. 6 is a plan view of an air tube-side connector of the present embodiment, FIGS. 7A and 7B are views of an air tube-side connector of the present embodiment from a mating surface side thereof, and FIG. 8 is a cross-sectional view relating to section A in FIG. 5, illustrating a process of removing a connector of the air mattress with an internal pump according to the present embodiment.

First, the configuration of the air mattress according to the present embodiment will be described. As shown in FIG. 1, an air mattress 1 according to the present embodiment is laid upon, for example, a frame of a bed 2 having a raisable back frame and used. As also shown in FIG. 1, the bed 2 of the present embodiment is an electric bed in which a piston rod at the tip of an actuator 2*b* is made to advance or retract through operation of a bed hand switch 2*c*, and each of the frames is operated so as to electrically raise or lower the back in connection with various linkage mechanisms of the bed coupled to the tip of the piston rod. In the present embodiment, a deformation gauge is provided on the piston rod of the actuator 2*b* as an external sensor 3, and is configured so as to be capable of detecting a load placed upon the piston rod via the frame of the electric bed 2. A configuration in which a control circuit 2*a* detects the current needed to drive the actuator 2*b*, thereby enabling detection of the load placed upon the piston rod, is also possible. It is then possible to use the load detected according to these methods to determine, for example, whether or not a person is on the bed. In the bed 2, sensors for detecting the raising angle of the frames that engage in raising are provided on each as external sensors 3. There are also electric beds having configurations wherein not only a back frame but also a knee frame is simultaneously raisable; in the case of these as well, it is possible to measure the load placed upon the knee frame using a deformation gauge provided on the piston rod of the actuator 2*b* coupled to a linkage mechanism of the knee frame, as well as to provide a sensor for detecting the raising angle of the knee frame.

As shown in FIGS. 2 through 4, the air mattress 1 according to the present invention is provided with a plurality of air cell groups 10 constituted by a plurality of bladder-shaped cells and lined up in the lengthwise direction of the air mattress, an air supply/release pump 11, an air tube 13 connecting the bladder-shaped cells of each of the air cell groups 10 to the air supply/release pump 11, and a mattress control circuit 15 for controlling air supply/release by the air supply/release pump for each of the air cell groups, and the plurality of air cell groups 10, the air tube 13, and the air supply/release pump 11 constitute an integrated whole. In the present embodiment, as shown in FIG. 1, the mattress control circuit 15 is also connected to the control circuit 2*a* of the electric bed.

As shown in FIG. 3, each of the bladder-shaped cells of the plurality of air cell groups 10 is a rod-shaped cell extending in the widthwise direction of the air mattress 1, and the plurality of bladder-shaped cells are lined up in the lengthwise direction of the air mattress to constitute the main body of the air mattress. As shown in FIG. 3 and FIG. 4, a plurality of bladder-shaped cells are disposed corresponding to each of a head area, a shoulder area, a buttock area, a thigh area, a knee area, heel area of a person lying on the air mattress. In the present embodiment, as shown in FIG. 4, the cells corresponding to the back area, buttock area, and thigh area of the mattress user are divided into upper sections and lower sections, and the air pressure for each is controlled by different systems. Each of the bladder-shaped cells are, for example, formed by stitching together resin materials such as nylon fibers or the like, and bladder-shaped cells disposed adjacent to one another are fixed together by, for example, being stitched together. The fixing of adjacent bladder-shaped cells may also be performing using, for example, an adhesive. In this way, the air, mattress 1 supports the body of a person lying on the mattress by having the plurality of rod-shaped cells extending in the widthwise direction of the air mattress being lined up in the lengthwise direction of the air mattress, and the interior of each of the bladder-shaped cells being filled with air. By adjusting the air pressure within the bladder-shaped cells according to the part of the body, it is possible, for example, to cause the pressure within the bladder-shaped cells for the back area and the thigh area to be greater than that of the pressure within the bladder-shaped cells for the buttock area, thus enabling dispersion of body pressure. Each of the plurality of bladder-shaped cells is provided at at least one location with an air supply/release terminal for connecting to the air tube. In the present embodiment, each of the bladder-shaped cells is provided with an air supply/release terminal at one location, and each bladder-shaped cell is configured so as to be capable of being inflated and deflated by means of connecting the air tube 13 to the air supply/release terminal and supplying air to or releasing air from the bladder-shaped cell via the air tube 13 of each system. The air tube 13 used is preferably, for example, manufactured from a resin such as vinyl chloride.

In the present embodiment, as shown in FIG. 4, the plurality of bladder-shaped cells in an air cell group 10*a*, which corresponds to the head area of a person lying on the air mattress, is connected to a common air tube 13 so that air is supplied or released through an independent air supply/release system, and the plurality of bladder-shaped cells in an air cell group 10*g*, which corresponds to the heel area, is connected to a common air tube 13 so that air is supplied or released through a single independent air supply/release system. Furthermore, out of the bladder-shaped cells of an air cell group 10*c* corresponding to the back area of a person lying on the air mattress, the bladder-shaped cells in a lower section are connected to an air tube 13 shared with the bladder-shaped cells in a lower section of an air cell group 10*e* corresponding to the thigh area, and are configured so that air is supplied or released through a single independent air supply/release system (system A). Likewise, the bladder-shaped cells in a lower section of an air cell group 10*d* corresponding to the buttock area is connected to a common air tube 13 so that air is supplied or released through a single independent air supply/release system (system B). In the present embodiment, the plurality of bladder-shaped cells of an air cell group 10*b* corresponding to the shoulder area of a person lying on the air mattress is connected to one of three independent air supply/release systems (system 1, system 2, and system 3) via an air tube 13, and is configured so that independent air supply or release is performed for each. Likewise, the pluralities of bladder-shaped cells of air cell groups 10*c* through 10*f* corresponding to the back area (upper section), buttock area (upper section), thigh area (upper section), and knee area are connected to one of three independent air supply/release systems (system 1, system 2, and system 3) via an air tube 13, and are configured so that independent air supply or release is performed for each. As shown in FIG. 4, the bladder-shaped cells of each of the three air supply/release systems are disposed in alternation in the order system 1, system 3, system 2, system 1, system 3 . . . from the shoulder area to the knee area. Bladder-shaped cells in the same air supply/release system (system 1, system 2, or system 3) are each connected to a common air tube 13. In the present embodiment, an air injection tube 13 for supplying air to one independent system is laid on a lower surface of the mattress, and is configured so that, by supplying air to the air injection tube, air is ejected from a plurality of injection holes provided on an outer surface of the air injection tube, enabling moisture to be removed from the mattress. Specifically, the present embodiment is provided with four air supply/release systems for controlling blocks for the head area, heel area, buttock area (lower section), and back area (lower section) and thigh area (lower section) of the mattress user; with three air supply/release systems—system 1, system 2, and system 3—for alternating inflation/deflation; and with one air supply system for injecting air, for a total of eight air supply/release systems. It is thereby possible to individually adjust the air pressure within the bladder-shaped cells according to the part of the body, thus dispersing body pressure. For example, the pressure within the bladder-shaped cells of air cell groups 10*c*, 10*e* for the back area and thigh area is set to be greater than the pressure within the bladder-shaped cells of air cell group 10*d* for the buttock area. Each of the bladder-shaped cells is provided with a pressure sensor for measuring internal pressure, and the value measured by the pressure sensor can be output to a hand switch described below or the control circuit of the bed. In this case, a pressure sensor may be provided for all of the bladder-shaped cells, or a shared pressure sensor may be set for one air supply/release system.

In the present embodiment, as shown in FIG. 3, out of the bladder-shaped cells of the plurality of air cell groups 10, the bladder-shaped cells of air cell group 10*g*, which is disposed in correspondence to the heel area of a person lying on the air mattress, are shorter than the bladder-shaped cells of the other air cell groups (10*a* through 10*f*), and the bladder-shaped cells of the other air cell groups 10 extend to the edge of the air mattress. Thus, there is a space left between the bladder-shaped cells of air cell group 10*g*, which corresponds to the heel area, and the edge of the air mattress. The length of the bladder-shaped cells 10*g* disposed in correspondence to the heel area of the mattress user is, for example, up to 30% less than that of the other bladder-shaped cells 10*a* through 10*f*. In other words, in the collection of bladder-shaped cells in which a plurality of bladder-shaped cells are arranged and formed so as to describe a rectangle as a whole when seen in a plan view, out of the four corners thereof, there is a space in one of the corners by the heel area of the person lying on the air mattress in which bladder-shaped cells are not disposed.

An air supply/release pump 11 is disposed within the space in which bladder-shaped cells are not disposed so that the lengthwise direction thereof is, for example, perpendicular to the lengthwise direction of each of the bladder-shaped cells 10; i.e., so that the lengthwise direction is oriented in the direction from the head area to the leg area of the person lying on the air mattress. The air supply/release pump 11 is thereby disposed in a corner out of the four corners of the air mattress 1, which is configured so as to describe a rectangle as a whole when seen in a plan view, that corresponds to the heel area of the person lying on the mattress. The part corresponding to the side of the heel area is a part that the body of the user of the air mattress does not readily contact even if the user turns over while sleeping, so that sleeping comfort is not reduced. By disposing the air supply/release pump 11 in an area within the range of the width and length of the air mattress constituted by the plurality of air cell groups 10, there is no need to dispose the pump 11 externally with respect to the air mattress, and handling is facilitated. The height of the air supply/release pump 11 is, for example, equal to or less than that of each of the air cell groups 10, creating a configuration in which it is possible to prevent the air supply/release pump 11, which is harder than the air-filled bladder-shaped cells, from jutting out beyond the air cell groups 10 in the height direction, as well as to prevent the position of the person lying on the air mattress from being higher than that of the side rails when the air mattress is placed on a bed having, for example, side rails. The exterior surface of the air supply/release pump 11 is covered by a flexible member of, for example, urethane, and is configured to simultaneously soften any shocks in case the person on the air mattress or a caretaker or the like comes in contact with the air supply/release pump 11 and protect the air supply/release pump 11.

In the present embodiment, as shown in FIG. 2, the plurality of air cell groups 10 and the air supply/release pump 11 are covered by a single top cover 14 of, for example, nylon fibers coated with polyurethane, and the upper surfaces thereof are protected. Because the upper surfaces of the air cell groups 10 and the air supply/release pump 11 are covered with the top cover 14, the lower surface of the air supply/release pump 11 is exposed to the exterior at one side surface in the widthwise direction of the air mattress 1 and a side surface corresponding to the heel area of the mattress user in the lengthwise direction of the air mattress 1. When a top cover is provided, as in the case of the present embodiment, the collection of air cell groups formed by the plurality of air cell groups 10 and/or the air supply/release pump 11 is provided with a structure so that the top cover 14 can be fixed thereto, and the air supply/release pump 11 is fixed, for example, to the air cell groups 10.

As shown in FIG. 2, the air supply/release pump 11 is provided on, for example, a side exposed to the exterior on an end of the air mattress 1 in the lengthwise direction with one each of a power input cord and a cord, connected to the mattress control circuit 15, for sending and receiving signals with the mattress control circuit 15; and if a hand switch 16 is provided, a cord for sending and receiving signals with the hand switch 16 is provided. In the present embodiment, a hand switch 16 is not provided, and the air supply/release pump 11 is configured so as to be driven by power inputted from a power source and to send and receive signals with the mattress control circuit 15, thereby changing, for example, the rotation rate of a fan provided within the pump 11 and adjusting the amount of air supply/release, allowing the pressure within each of the bladder-shaped cells 10 to be adjusted.

In the present embodiment, as shown in FIG. 5, the air tubes 13 are connected to the air supply/release pump 11 by means of a connector. An air supply/release pump-side connector 110 is provided in two locations on, for example, a side of the air supply/release pump 11 in the lengthwise direction opposite to that of the power cord. In the present embodiment, each of the air supply/release pump-side connectors 110 is provided with four air supply/release mouths 110*a*; and of the total of eight air supply/release mouths 110*a* provided on the air supply/release pump 11, seven are configured as air supply/release mouths for supplying and releasing air to and from the bladder-shaped cells connected to the head area, heel area, system 1 through 3, and system A and B via the air tubes 13. The remaining one of the eight air supply/release mouths 110*a* is configured as an air supply mouth, and it is possible to expel air from the plurality of injection holes provided on the outer surface of the air injection tube by supplying air to the air injection tube provided on the lower surface of the mattress, thus moisture to be removed from the mattress. In the present embodiment, as shown in FIG. 6, an air tube-side connector 12 can connect four air tubes; thus, by connecting two air tube-side connectors 12 to the air supply/release pump 11 as shown in FIG. 4, the pressure within the corresponding bladder-shaped cells is controlled by the seven air supply/release systems via the air tubes 13 for each of the systems, and moisture is removed from the mattress by the one air injection system. FIG. illustrates an example of an arrangement of air intake/release terminals 12*a* corresponding to the eight air supply/release systems.

As shown in FIG. 5, each of the two air supply/release pump-side connectors 110 is provided with four air supply/release mouths 110*a*; and by inserting the air intake/release terminals 12*a* of the air tube-side connectors 12 shown in FIG. 6 into the air supply/release mouths 110*a* and engaging a projection on a side of a connector cover 12*b* with an indentation on interior surfaces of the air supply/release pump-side connectors 110, the air tube-side connectors 12 are mated with the air supply/release pump-side connectors 110. Rubber seals 12*c* are provided on exterior surfaces of the air intake/release terminals 12*a* of the air tube-side connectors 12, increasing the strength of the seal between the air supply/release mouths 110*a* and the air intake/release terminals 12*a*.

The present embodiment is configured so that, when the connectors 12 are removed from the air supply/release pump 11 as shown in FIG. 8, the connections between all of the air tubes 13 and each of the eight air supply/release systems are released, thus releasing control of the pressure within the bladder-shaped cells, and the air within all of the bladder-shaped cells is rapidly released through the air tubes 13 of each of the air supply/release systems.

Figure 8A:
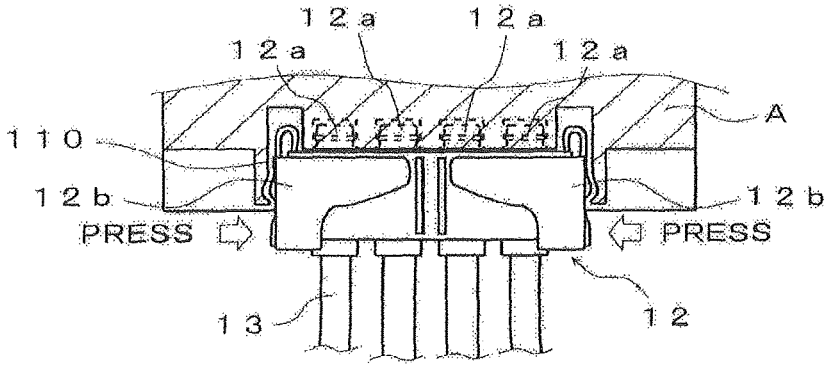
FIGS. 8A through 8C are partial plan views illustrating a process of removing a connector of an air mattress with internal pump according to an embodiment of the present invention.
Figure 8B:
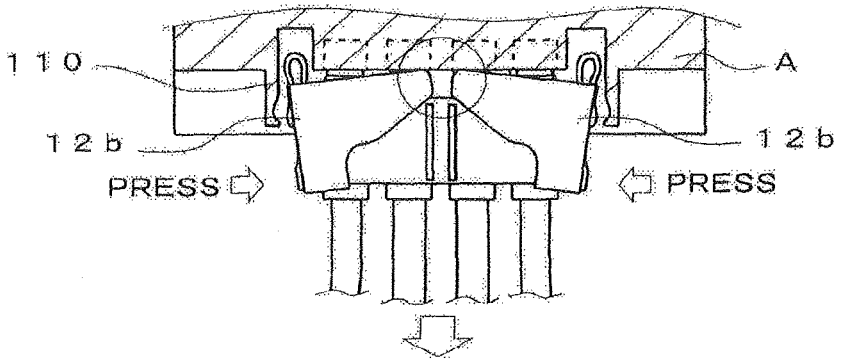

As shown in FIG. 8A and FIG. 8B, the connector 12 of the present embodiment is configured so that front ends of the connector covers 12*b* project in directions facing towards each other; and when rear ends of the connector covers 12*b* are pressed in directions approaching each other, the projecting tips of the connector covers 12*b* press upon the surface upon which the air supply/release mouths of the air supply/release pump-side connectors 110 are provided (the mating surface), as shown in FIG. 8B, at the same time that the projections on the sides of the connector covers 12*b* and the indentations on the inner surface of the air supply/release pump-side connector 110 disengage.

In the present embodiment, the mattress control circuit 15 is connected to the control circuit 2*a* of the electric bed 2, and the back raising angle of the frame is input as a signal either via the control circuit 2*a* or directly from the sensor 3. It is configured to then control, for example, the rotation rate of the fan for each of the air supply/release systems of the air supply/release pump 11 according to the back raising angle on the basis of the back raising angle signal so that, for example, a predetermined pressure value is obtained, thus controlling the pressure within each of the bladder-shaped cells connected to said seven air supply/release systems.

Next, the operation of the air mattress according to the present embodiment will be described. In the present embodiment, when the bed hand switch 2*c* of the electric bed 2 is operated, a command from the bed hand switch is first inputted to the control circuit 2*a* of the electric bed 2. Then, on the basis of the signal from the bed hand switch, the electric bed control circuit 2*a* supplies power to the actuator 2*b*, thereby beginning the advancement or retraction of the piston rod at the tip of the actuator 2*b*. Simultaneously, a sensor (external sensor 3) provided on the bed 2 begins to detect the raising angle of the frame, and sends detected results to the electric bed control circuit 2*a* as needed. The mattress control circuit 15 receives the signal regarding the back raising angle of the back frame either via the electric bed control circuit 2*a* or directly from the sensor 3. When a sensor for detecting the raising angle of the knee frame is provided, a configuration in which the raising angle of the knee frame is also received is possible. The mattress control circuit 15 thereby decides the optimal pressure for each of the bladder-shaped cells connected to each of the air supply/release systems according to the inputted raising angle signal for each frame. At this time, the mattress control circuit 15 controls the internal pressure of each of the bladder-shaped cells connected to each of the air supply/release systems so that, for example, the pressure in air cell groups 10*c*, 10*e*, corresponding to the back area and thigh area, is higher than the pressure within air cell group 10*d*, corresponding to the buttock area, and furthermore so that the pressure within the air cell group 10*d* corresponding to the buttock area increases as the angle to which the back frame is raised increases.

Specifically, in the present embodiment, the mattress control circuit 15 controls, for example, the rate of rotation of the fans of the air supply/release pump 11 corresponding to each of the air supply/release systems, thereby controlling the air supply/release amount for each of the air supply/release systems so that the pressure within the bladder-shaped cells connected to each of the air supply/release systems becomes a predetermined pressure. The internal pressure of the bladder-shaped cells corresponding to each of the air supply/release systems is thereby set to an optimal value when the frames of the electric bed 2 have been raised or lowered so as to reach a predetermined back raising angle. The value set for the internal pressure of the bladder-shaped cells is a pressure such that the body weight of the mattress user is dispersed evenly over the mattress, and, for example, large localized pressure is not placed upon the mattress user and the mattress user does not feel as though there is a foreign object present or experience other types of discomfort; and is set to a value experienced in experiments or the like. Of the values set for the internal pressure, the pressure of, for example, the air cell groups 10*c*, 10*e* corresponding to the back area and thigh area are set higher than the pressure within the air cell group 10*d* corresponding to the buttock area, and the pressure within each of the air cell groups increases as the angle to which the back frame is raised increases.

In the present embodiment, it is possible to control the internal pressure of the air mattress according to the movements of the bed. Specifically, the mattress control circuit 15 performs control so as to increase the pressure within the air cell groups supporting, for example, the back area and thigh area (10*c* and 10*e*, respectively) of the person lying on the air mattress 1 when the back frame is in a raised state. It is thereby possible to stably support the buttock area of the person on the mattress from both sides thereof by means of the air cell groups supporting the back area and thigh area even when the back frame of the bed has been raised, and to stably support the mattress user without the occurrence of mattress compression even when the back frame of the bed has been raised.

In the present embodiment, because it is not the pressure in the air cell group 10*d* supporting the buttock area of the person lying on the mattress 1, but rather the pressure in the air cell groups (10*c* and 10*e*, respectively) supporting the back area and thigh area on both sides of the buttock area, that is increased in order to prevent mattress compression, it is possible to effectively distribute body pressure using the air mattress without the repelling force from the air mattress placed upon the buttock area of the area increasing and sleeping comfort being reduced.

In the present embodiment, by continuously altering the pressure within each of the bladder-shaped cells when the back frame of the bed 2 has been raised, it is possible to obtain an air mattress having, for example, a massage function or a decubitus ulcer prevention function.

At this time, the mattress control circuit 15 controls the pressure within the bladder-shaped cells corresponding to each of the air tubes 13 connected, for example, to the four block control air supply systems, except for those in the air cell group 10*g* corresponding to the heel area, so that the pressure is constantly at a fixed amount. The pressure in the air cell group 10*g* corresponding to the heel area is controlled so as to inflate or deflate within a predetermined pressure range at a fixed interval. In other words, when the body weight of the person lying on the mattress is, for example, from 30 to 135 kg, each of the air cell groups is separately controlled so that the pressure within the bladder-shaped cells of air cell group 10*a*, which corresponds to the person's head area, is for example from 1.6 to 4.3 kPa; the pressure within the bladder-shaped cells of air cell group 10*g*, which corresponds to the person's heel area, is for example from 1.1 to 3.0 kPa; the pressure within the bladder-shaped cells of the lower sections of air cell group 10*c* and 10*e* (system A), which correspond to the person's back area and thigh area, is for example from 1.5 to 6.4 kPa; and the pressure within the bladder-shaped cells of the lower section of air cell group 10*d* (system B), which corresponds to the person's buttock area, is for example from 1.1 to 3.3 kPa. By controlling the pressure within the bladder-shaped cells of the air cell group 10*a* corresponding to the head area of the person lying on the air mattress so that the pressure is a fixed amount, it is possible to stably support the locations corresponding to bones protruding outward from the back area of the body of the mattress user (the occipital bone) when the user is in a reclined state. By controlling the pressure within the bladder-shaped cells of the lower sections of air cell group 10*c* and 10*e* (system A), which correspond to the back area and thigh area of the mattress user, so as to be greater than the pressure within the bladder-shaped cells of the lower section of air cell group 10*d* (system B), which corresponds to the buttock area, it is possible to stably support the buttock area, which protrudes toward the mattress and thus receives a larger load of the body's weight compared to other locations when the user is in a reclined state, from both sides, i.e., using the bladder-shaped cells of air cell group 10*c* and 10*e*, which correspond to the back area and the thigh area; this in turn enables one to prevent the repelling force from the bladder-shaped cells of the air cell group 10*d* corresponding to the buttock area from becoming too great, promoting dispersion of body pressure. Furthermore, by inflating or deflating the air cell group 10*g* corresponding to the heel area at a fixed interval, it is possible to switch the part supporting the heel area between the thigh and the heel at a fixed interval, preventing repelling force from the mattress being placed upon the heel of the person for long periods of time.

Meanwhile, for example, with regards to the three alternating inflation/deflation air intake systems, the mattress control circuit 15 first sets the amount of air supplied to the air tube 13 of the air intake/release system of system 1 to an amount smaller than the amount supplied to the air tubes 13 of the air intake/release systems of system 2 and system 3, and sets the amount of air being supplied to the air tubes 13 of system 2 and system 3 to roughly equal levels. The pressure within the bladder-shaped cells connected to the air tubes of system 1 thereby becomes the smallest, and the pressure within the bladder-shaped cells connected to the air tubes of system 2 becomes roughly equal to the pressure within the bladder-shaped cells connected to the air tubes of system 3 and greater than the pressure within the bladder-shaped cells of system 1. At this time, in cases where a pressure sensor is provided in the bladder-shaped cells of each of the systems, the control circuit increases or decreases the amount of air supplied to each of the systems on the basis of the measured values outputted from the pressure sensors as appropriate, allowing the pressure within the bladder-shaped cells connected to the air tubes 13 connected to each of the systems to be rapidly set to a predetermined set value.

After maintaining the internal pressure of the bladder-shaped cells connected to the air tubes 13 of each of the three alternating inflation/deflation systems in this state for a predetermined period of, for example, 460 seconds or less, the mattress control circuit 15 controls the amount of air supplied or released by the seven air supply/release systems, thereby increasing the pressure within the bladder-shaped cells of system 1, decreasing the pressure within the bladder-shaped cells of system 2, and maintaining the pressure within the bladder-shaped cells of system 3 at a fixed level. During a pressure transition period of, for example, 170 seconds or less, the pressure within the bladder-shaped cells of system 2 thereby becomes the smallest, and the pressure within the bladder-shaped cells of system 1 and the pressure within the bladder-shaped cells of system 3 become roughly equal to each other and greater than the pressure within the bladder-shaped cells of system 2. For example, the pressure within the bladder-shaped cells corresponding to the head area, back area (lower section), buttock area (lower section), thigh area (lower section), and heel area are maintained at a fixed level.

In this state, the mattress control circuit 15 controls the internal pressure of each of the bladder-shaped cells according to a method similar to that described above. In other words, the mattress control circuit 15 controls the amount of air being supplied or released by the seven air supply/release systems after a predetermined period of, for example, 460 seconds or less so that, during a pressure transition period of 170 seconds or less, the pressure within the bladder-shaped cells of system 3 becomes the smallest, and the pressure within the bladder-shaped cells of system 1 and the pressure within the bladder-shaped cells of system 2 become roughly equal to each other and greater than the pressure within the bladder-shaped cells of system 3. The pressure within the bladder-shaped cells corresponding to the head area, back area (lower section), buttock area (lower section), thigh area (lower section), and heel area are maintained at a fixed level.

By controlling the pressure within the bladder-shaped cells connected to the air tubes 13 of each of the air supply/release systems, it is possible to continuously vary the pressure within the bladder-shaped cells 10 corresponding to the shoulder area, back area, buttock area, thigh area, and knee area of a person, thereby preventing the same amount of pressure from being placed on specific parts of the skin for long periods of time, and thus decubitus ulcers from occurring. It is also possible to obtain an effect of massaging the person on the mattress.

When the air mattress according to the present embodiment is used for medical or caretaking purposes, the decubitus ulcer prevention function or massage function is stopped when medical or caretaking work is being performed upon the person on the mattress. In other words, either the pressure within each of the bladder-shaped cells is maintained at a fixed level while the decubitus ulcer prevention function of the air mattress is in operation, or after the pressure within the bladder-shaped cells connected to the air tubes 13 of each of the systems has been set to a pressure suitable for medical or caretaking work or the like, the set pressure is maintained, or the pressure within all of the bladder-shaped cells is set to the same level and maintained at the set pressure.

In the air mattress 1 according to the present embodiment, the air supply/release pump 11 is internal to the mattress, so that the air supply/release pump does not get in the way, improving the ease of performing medical or caretaking work and reducing the amount of space in which the air supply/release pump 11 is provided.

Figure 8C:
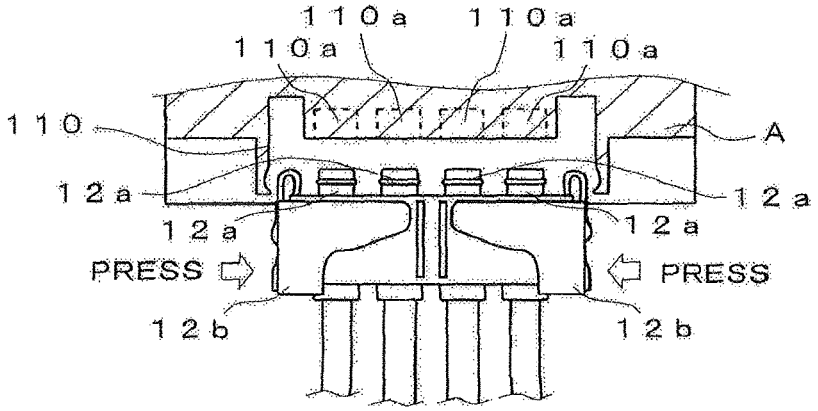

When the air mattress of the present embodiment is used for medical or caretaking purposes, the elasticity of the air mattress may impede medical treatment if it becomes necessary to perform emergency medical treatment, such as cardiopulmonary resuscitation, upon the mattress user. When this happens, the air tubes are detached from the air supply/release pump. In the air mattress 1 according to the present embodiment, the air tubes 13 are connected to the air supply/release pump 11 by means of the connector 12. As shown in FIG. 8A through FIG. 8C, the connector 12 of the present embodiment is configured so that when rear ends of the connector covers 12*b* are pressed in directions approaching each other, the projecting tips of the connector covers 12*b* press upon the surface upon which the air supply/release mouths of the air supply/release pump-side connectors 110 are provided (the mating surface), as shown in FIG. 8B, at the same time that the projections on the sides of the connector covers 12*b* and the indentations on the inner surface of the air supply/release pump-side connector 110 disengage. Thus, a caretaker or the like can quickly remove the connector 12 from the air supply/release pump 11 simply by pressing the sides of the connector 12, thereby enabling smooth release of air from all the bladder-shaped cells.

When there is a need to move the air mattress along with the bed, after, for example, a transport mode switch provided on the hand switch is pressed, a plug at the tip of the power cord of the air supply/release pump 11 is removed from a power supply course such as, for example, an electrical socket. The air supply/release pump 11 is configured so that, by pushing the transport mode button on the hand switch, the air supply/release mouths are closed so that air is not released from, for example, each of the air supply/release systems, and the pressure within each of the bladder-shaped cells is maintained at a fixed level. Large depressions due to depressurization of the bladder-shaped cells when the mattress user is being transported are prevented, and thus the occurrence of decubitus ulcers due to the buttock area of the mattress user being compressed by the frame of the bed is prevented.

In the air mattress 1 according to the present embodiment, because the air supply/release pump 11 is disposed at a corner of the mattress, it is easy to contact the air supply/release pump 11 when performing maintenance upon the air supply/release pump 11 and the air tubes 13 when the air mattress is not in use. In this case, when the air tubes 13 are detached from the air supply/release pump 11, if the air supply/release pump 11 is configured so as to be removable from the mattress, maintenance of the air supply/release pump 11 and the air tubes 13 becomes even easier.

As described above, it is possible in the present embodiment to control the internal pressure of the air mattress according to the movements of the bed. Specifically, the pressure within each of the bladder-shaped cells is set to a value optimal for the person on the mattress even when the back of the bed has been raised. At this time, because the mattress control circuit 15 performs control so that the pressure of the air cell groups (10*c* and 10*e*, respectively) supporting the back area and thigh area of the person lying on the air mattress is increased when the back frame of the bed 2 is raised, it is possible to stably support the buttock area of the person on the mattress from both sides thereof using the air cell groups supporting the back area and thigh area even when the back frame of the bed has been raised, and to stably support the mattress user without the occurrence of mattress compression even when the back frame of the bed has been raised.

Also, because it is not the pressure in the air cell group 10*d* supporting the buttock area of the person lying on the mattress 1, but rather the pressure in the air cell groups (10*c* and 10*e*, respectively) supporting the back area and thigh area on both sides of the buttock area, that is increased in order to prevent mattress compression, it is possible to effectively distribute body pressure using the air mattress without the repelling force from the air mattress placed upon the buttock area of the area increasing and sleeping comfort being reduced.

Furthermore, in the present embodiment, because the mattress control circuit 15 controls the pressure of each of the air cell groups so that the pressure within the air cell group 10*d* corresponding to the buttock area increases as the angle to which the back frame is raised increases, it is possible to obtain the effects of the present invention regardless of the back raising angle.

In the present embodiment, the bed was described as being an electric bed, but the angle-detecting sensor may also be provided on a bed configured so as not to use electrical power in raising the back frame, and the effects of the present invention can be obtained.

Figure 9:
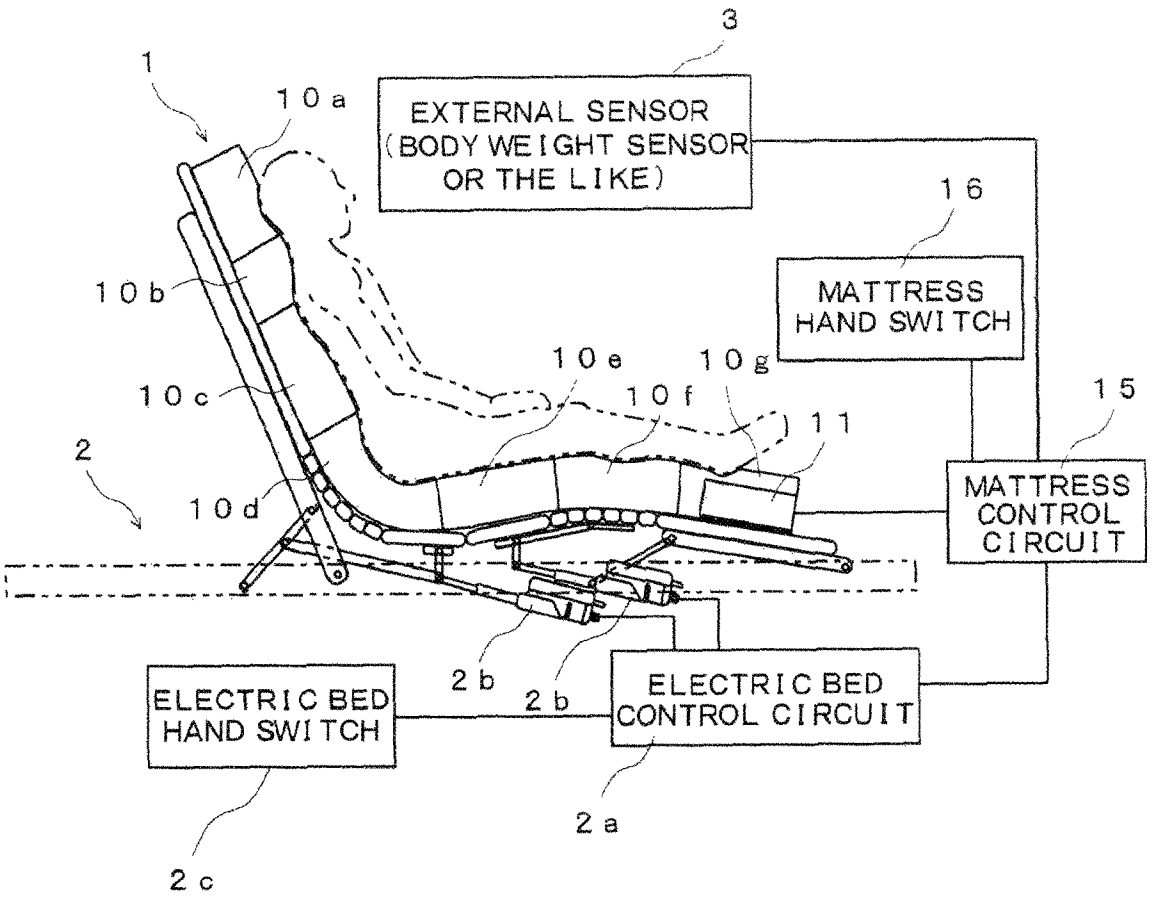
FIG. 9 is a schematic view of an air mattress and a bed according to a second and third embodiment of the present invention.

Next, an air mattress according to a second embodiment of the present invention will be described. FIG. 9 is a schematic view of an air mattress and a bed according to a second embodiment of the present invention. In the present embodiment, as shown in FIG. 9, the air mattress 1 is further provided with a hand switch 16 in addition to the configuration of the first embodiment, and is configured so that the body weight of the person lying on the mattress is inputted into the hand switch 16. The hand switch 16 is connected to the control circuit 15 of the mattress. Specifically, in the present embodiment, the mattress control circuit 15 is configured so as to control the internal pressure of the bladder-shaped cells 10 corresponding to each of the air supply/release systems according to the body weight of the person on the mattress.

Specifically, in the present embodiment, the mattress control circuit 15 performs a control so as to increase the pressure in the air cell groups 10*c*, 10*e* supporting the back area and thigh area of the person lying on the air mattress when the back frame of the bed 2 is raised; the optimal pressure value for when the back frame of the bed is raised is set in the mattress control circuit 15 according to the bladder-shaped cells of each of the air supply/release systems on the basis of the body weight of the person on the mattress in addition to the back raising angle of the back frame; and the mattress control circuit 15 performs a control so as to increase the pressure of the air cell groups the greater the back raising angle of the back frame and the greater the body weight of the person on the mattress.

In the air mattress according to the present embodiment, it is possible to control the internal pressure of the air mattress according to the movements of the bed. Specifically, because the mattress control circuit 15 performs a control so that the pressure of, for example, the air cell groups (10*c* and 10*e*, respectively) supporting the back area and thigh area of the person lying on the air mattress is increased when the back frame of the bed 2 is raised, it is possible to stably support the buttock area of the person on the mattress from both sides thereof by means of the air cell groups supporting the back area and thigh area even when the back frame of the bed has been raised, and to stably support the mattress user without the occurrence of mattress compression even when the back frame of the bed has been raised. Also, because it is not the pressure in the air cell group 10*d* supporting the buttock area of the person lying on the mattress 1, but rather the pressure in the air cell groups (10*c* and 10*e*, respectively) supporting the back area and thigh area on both sides of the buttock area, that is increased in order to prevent mattress compression, it is possible to effectively distribute body pressure using the air mattress without the repelling force from the air mattress placed upon the buttock area of the area increasing and sleeping comfort being reduced.

In the present embodiment, it is further possible to set an optimal internal pressure value for the bladder-shaped cells connected to each of the air supply/release systems on the basis of the body weight of the person on the mattress in addition to the raising angle of the back frame (and the knee frame). In the mattress according to the first embodiment, the pressure within each of the bladder-shaped cells is set to the same value for person with large body weights and persons with low body weights. However, in this case, depending on the set pressure, a large degree of cave-in may occur in the area of the mattress corresponding to, for example, the buttock area in the case of a person with a large body weight; and, in the case of a person with a low body weight, the repelling force from the mattress may increase at, for example, the buttock area, causing the person on the mattress to feel discomfort. However, in the present embodiment, an optimal value is set according to the body weight of the person on the mattress so that the pressure of the air cell groups increases the greater the body weight of the person, allowing the effects of the invention to be obtained regardless of the body weight of the mattress user.

Next, an air mattress according to a third embodiment of the present invention will be described. In the present embodiment, in addition to the air mattress according to the second embodiment, the hand switch 16 is configured to allow the sex of the person lying on the mattress to be inputted in addition to the body weight. The mattress control circuit 15 is thus configured so as to control the internal pressure of the bladder-shaped cells corresponding to each of the air supply/release systems according to the sex of the mattress user. Specifically, in the present embodiment, an optimal value is set in the mattress control circuit according to the bladder-shaped cells connected to each of the air supply/release systems on the basis of a combination of the back raising angle of the bed and the body weight and sex of the person lying on the mattress.

In the present embodiment, in addition to the effects of the second embodiment, because the internal pressure of the bladder-shaped cells connected to each of the air supply/release systems is set to an optimal value according to sex as well for men and women, who have different average figures, the effects of the present invention can be obtained regardless of the sex of the person on the mattress.

Figure 10:
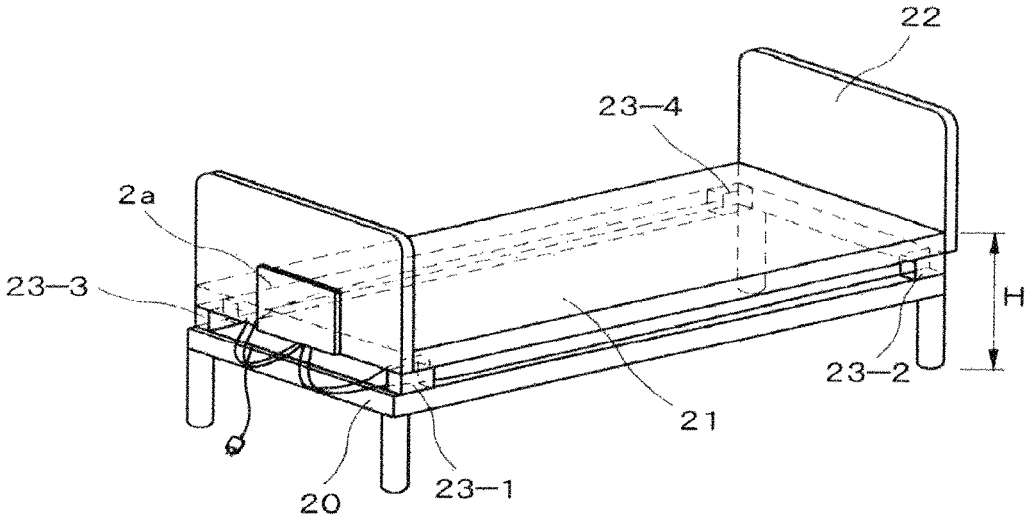
FIG. 10 is a schematic view of a bed upon which an air mattress according to a fourth embodiment of the present invention is set.
Figure 11:
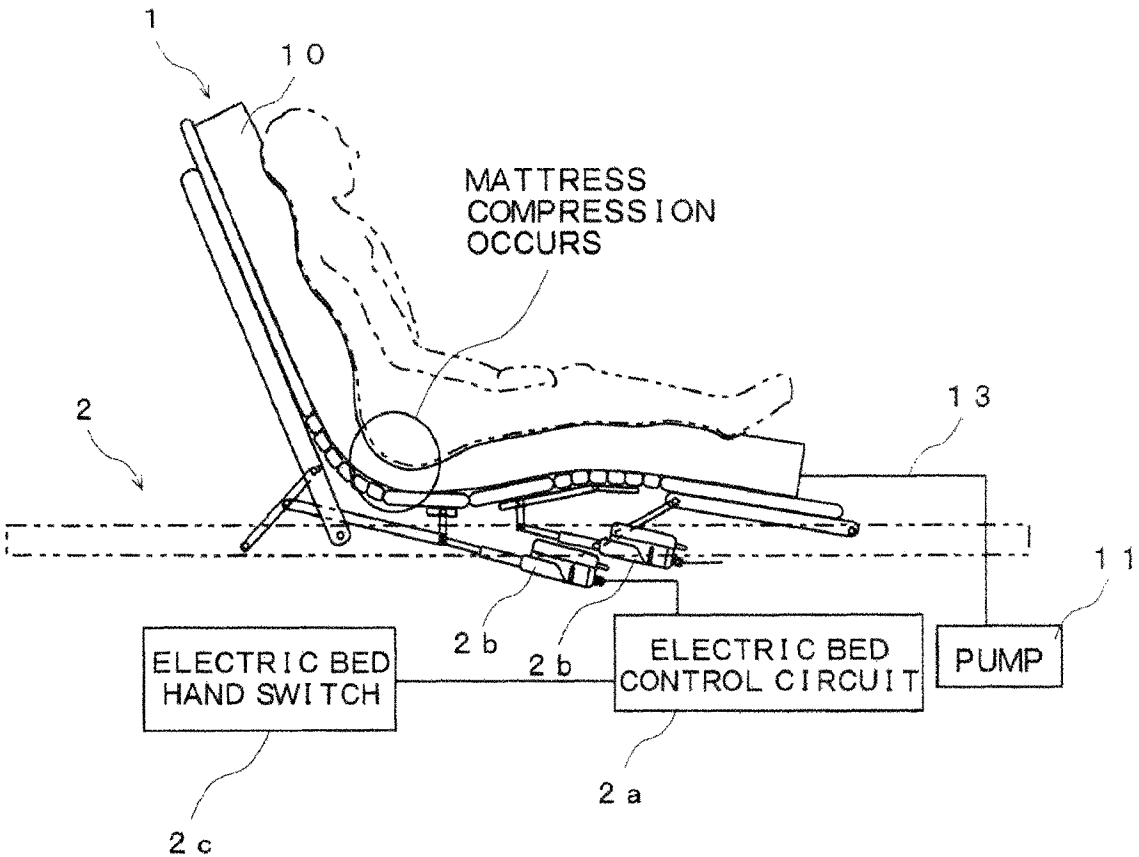
FIG. 11 is a schematic view of a conventional air mattress being laid upon and used with a bed having a back raising function.

Next, an air mattress according to a fourth embodiment of the present invention will be described. FIG. 10 is a schematic view of a bed upon which an air mattress according to a fourth embodiment of the present invention is set.

In the second and third embodiment described above, the hand switch 16 of the air mattress 1 had a configuration such that the body weight, or body weight and sex, of the person on the mattress was inputtable, and the control circuit 15 was configured so as to control the internal pressure of the bladder-shaped cells corresponding to each of the air supply/release systems according to the back raising angle of the back frame of the bed 2 and the body weight and/or sex of the mattress user; however, in the present embodiment, the bed 2 on which the air mattress 1 is laid is provided with, for example, a load sensor 23 as an external sensor 3 at each of the four corners thereof, as shown in FIG. 10, and is configured so as to detect the body weight of the person on the mattress using these load sensors 23-1 through 23-4. It is configured so that the body weight of the person on the mattress as detected by the load sensors 23 is thus inputted to the mattress control circuit 15 via, for example, the control circuit 2*a* of the electric bed shown in FIG. 1, or directly into the mattress control circuit 15. Specifically, the present embodiment has a configuration in which a sensor for detecting the raising angle of the back frame (and the knee frame) and a load sensor for detecting the body weight of the person on the air mattress are provided as external sensors 3, and signals from the two types of external sensor 3 are inputted to the mattress control circuit 15.

In the present embodiment, as in the second embodiment, an optimal value is set in the mattress control circuit 15 according the bladder-shaped cells connected to each of the air supply/release systems using a combination of the back raising (and knee raising) angles of the bed and the body weight of the person on the air mattress, and the internal pressure of each of the bladder-shaped cells connected to each of the air supply/release systems is set to an optimal value according to the body weight of the mattress user in addition to the back raising (and knee raising) angle of the bed. It is thereby possible to obtain effects similar to those of the second embodiment.

In the present embodiment, if the hand switch 16 is provided so as to be connected to the mattress control circuit 15, and the hand switch 16 is configured so that the sex of the person on the mattress is inputtable thereto, effects identical to those of the third embodiment described above can be obtained.

In the first through the fourth embodiments, a bed having a back raising function was described as an example, but the present invention can also be applied to a bed not having a back raising function. For example, by adopting a configuration in which a load sensor 23 is provided for a bed not having a back raising function and information from the load sensor 23 is receivable by an air mattress control circuit 15, it is possible to stop air supply to the air mattress when, for example, a person is not on the bed.

It is also possible to provide a bed not having a back raising function with, for example, a temperature/humidity sensor. It is thereby possible to cause the air supply/release pump 11 to operate and supply air to the air tube of the air injection system when the temperature or humidity of the mattress increases, thus injecting air into the interior of the mattress and reducing the temperature or humidity.

EXAMPLES

There follows a specific description of the effects of an example of the air mattress of the present invention in comparison to a comparative example. In this example, the air mattress was laid on the frame of a an electric bed, and, with a test subject on the mattress, the back frame of the bed was raised and the repelling force placed upon the test subject by the mattress was measured using a pressure sensor provided at the buttock area of the test subject.

The air mattresses used were an air mattress (type A), like that of the second embodiment described above, configured so as to control the pressure within each of the bladder-shaped cells according to the body weight of the person on the mattress in addition to the back raising angle of the bed, and to set the pressure of the air cell groups corresponding to the back area and thigh area of the mattress to a greater pressure than that of the air cell groups for the buttock area when the back frame has been raised; and two types of conventional air mattress (type B and type C) having specifications for being laid on a flat surface and used, i.e., not performing internal pressure control. The repelling force of the mattress when the back raising angle of the back frame was 0° and the test subject was in a prone or lateral recumbent position, and the repelling force of the mattress when the back frame was raised to 30° and to 75° when the test subject was in a prone position were measured. In order to stabilize the posture of the test subject, the leg frame was raised to 10° when the back frame was raised to 30°, and the leg frame was raised to 20° when the back frame was raised to 75°.

The mattress repelling force placed upon the buttock area of the test subject was measured in test subjects having a variety of body weights (6 males, 2 females) when in prone and lateral recumbent positions (back raising angle 0°) and when the back frame was raised to 30° and 75° (legs simultaneously raised to 10° and 20°). At this time, the internal pressure of the bladder-shaped cells of each of the air supply/release systems was set at from 1.5 to 3.5 kPa for the head area, heel area, and system 1 through 3; from 1.5 to 5.5 kPa for system A; and to 1.0 kPa or less for system B. Repelling force upon the buttock area is listed for each test subject in Table 1 for each test subject position and back frame back raising angle.

TABLE 1

| | No. | Mattress type | Test Subj. No. | Test Subj. Sex | Test Subj. Body weight kg | Prone mmHg | Lat. Recumbent mmHg | 30° back 10° leg mmHg | 75° back 20° leg mmHg |
|---|---|---|---|---|---|---|---|---|---|
| Examples | 1 | A | 1 | Male | 58 | 16.8 | 29.0 | 21.6 | 31.2 |
| | 2 | A | 2 | male | 85 | 24.2 | 30.6 | 27.2 | 39.0 |
| | 3 | A | 3 | Male | 87 | 24.2 | 28.7 | 28.8 | 47.8 |
| | 4 | A | 4 | Female | 45 | 18.3 | 31.7 | 19.5 | 28.9 |
| | 5 | A | 5 | Female | 42 | 17.5 | 26.9 | 19.2 | 32.7 |
| | 6 | A | 6 | Male | 65 | 21.2 | 27.0 | 23.3 | 34.6 |
| | 7 | A | 7 | Male | 73 | 18.5 | 32.3 | 21.4 | 33.9 |
| | 8 | A | 8 | Male | 54 | 15.6 | 24.2 | 18.6 | 35.2 |

TABLE 1-continued

| | No. | Mattress type | Test Subj. No. | Test Subj. Sex | Test Subj. Body weight kg | Prone mmHg | Lat. Recumbent mmHg | 30° back 10° leg mmHg | 75° back 20° leg mmHg |
|---|---|---|---|---|---|---|---|---|---|
| Comparative Examples | 9 | B | 1 | Male | 58 | 23.1 | 31.6 | 27.8 | 42.9 |
| | 10 | B | 2 | Male | 85 | 30.0 | 36.5 | 35.2 | 47.8 |
| | 11 | B | 3 | Male | 87 | 31.6 | 34.0 | 32.9 | 53.6 |
| | 12 | B | 4 | Female | 45 | 20.6 | 33.5 | 26.1 | 40.0 |
| | 13 | B | 5 | Female | 42 | 23.4 | 35.6 | 27.1 | 41.6 |
| | 14 | B | 6 | Male | 65 | 26.5 | 31.4 | 29.5 | 46.6 |
| | 15 | B | 7 | Male | 73 | 25.6 | 38.5 | 30.7 | 39.5 |
| | 16 | B | 8 | Male | 54 | 23.2 | 38.1 | 28.0 | 47.9 |
| | 17 | C | 1 | Male | 58 | 25.1 | 38.0 | 26.9 | 38.2 |
| | 18 | C | 2 | Male | 85 | 27.7 | 42.6 | 29.9 | 46.2 |
| | 19 | C | 3 | Male | 87 | 27.5 | 34.4 | 32.9 | 55.5 |
| | 20 | C | 4 | Female | 45 | 21.0 | 42.0 | 23.1 | 32.5 |
| | 21 | C | 5 | Female | 42 | 24.0 | 31.9 | 28.6 | 40.1 |
| | 22 | C | 6 | Male | 65 | 27.6 | 32.8 | 25.1 | 40.5 |
| | 23 | C | 7 | Male | 73 | 22.1 | 38.6 | 107.2 | 37.9 |
| | 24 | C | 8 | Male | 54 | 22.8 | 39.0 | 24.9 | 39.8 |

As shown in Table 1, in example 1 through 8, in which a person lay upon an air mattress configured so that the pressure in the air cell groups corresponding to the back area and thigh area of the person on the mattress (system A) was higher than the pressure in the air cell group for the buttock area (system B), the repelling force placed upon the buttock area of the person by the air mattress was less than in comparative examples 9 through 24, in which the person lay upon an air mattress configured not to control internal pressure. In particular, when the back frame of the bed was raised, the repelling force from the air mattress was low; and it was possible to stably support the mattress user even when the back frame of the bed was raised, thus enabling effective body pressure dispersion effects to be obtained by the air mattress.

INDUSTRIAL APPLICABILITY

The present invention is an air mattress enabling internal pressure to be controlled according to the movements of a bed, and prevent the occurrence of mattress compression and enables effective body pressure dispersion.

KEY

1 air mattress
10 air cell group
11 air supply/release pump
110 connector (air supply/release pump side)
110*a* air supply/release mouths
12 connector (air tube side)
12*a* air supply/release terminal
12*b* connector cover
12*c* rubber seal
13 air tube
14 top cover
15 mattress control circuit
16 hand switch
2 electric bed
2*a* electric bed control circuit
2*b* actuator
2*c* electric bed hand switch
23 load sensor
3 external sensor

The invention claimed is:

1. An air mattress comprising:

a plurality of air cell groups including air cell groups corresponding to the back area, the buttock area and the thigh area of a person lying on the air mattress, each of which groups comprising a plurality of air cells;

an air supply/release pump;

an air tube connecting said air cell groups corresponding to the back area and the thigh area to said air supply/release pump and connecting said air cell group corresponding to the buttock area to said air supply/release pump in an independent system for each other; and a controller for controlling the plurality of air cells, when said back area is raised, so that the pressure of said back-area and thigh-area air cell groups is greater than the pressure of said buttock-area air cell group.

2. The air mattress according to claim 1, wherein the air cells of said air cell groups comprise rod-shaped cells extending in a widthwise direction of the air mattress, and are configured so that the air cells are lined up in the lengthwise direction of the air mattress.

3. The air mattress according to claim 1, wherein:

said controller receives an information on the raising angle of said back area and controls air supply/release for the air supply/release pump.

4. A bed comprising the air mattress according to claim 1.

5. The air mattress according to claim 1, wherein the controller controls the plurality of air cells, when said back area is raised, so that the pressure of both of said air cell groups corresponding to the back area and thigh area is increased.

6. The air mattress according to claim 1, wherein the controller controls the plurality of air cells, when said back area is raised.

* * * * *